US006761625B1

(12) United States Patent
Rojhantalab et al.

(10) Patent No.: US 6,761,625 B1
(45) Date of Patent: Jul. 13, 2004

(54) RECLAIMING VIRGIN TEST WAFERS

(75) Inventors: Hossein Rojhantalab, Aloha, OR (US); Chi-Hwa Tsang, Beaverton, OR (US); Sean W King, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/441,448

(22) Filed: May 20, 2003

(51) Int. Cl.[7] ..... B24B 29/00
(52) U.S. Cl. ..... 451/288; 451/56; 451/5
(58) Field of Search ..... 451/288, 56, 5; 700/113; 414/222.01, 331.18; 118/719

(56) References Cited

U.S. PATENT DOCUMENTS

| | | | | |
|---|---|---|---|---|
| 5,622,875 A | | 4/1997 | Lawrence | 438/691 |
| 5,837,610 A | | 11/1998 | Lee et al. | 438/692 |
| 5,855,735 A | | 1/1999 | Takada et al. | 156/636.1 |
| 6,093,085 A | | 7/2000 | Yellitz et al. | 451/41 |
| 6,171,737 B1 | | 1/2001 | Phan et al. | 430/30 |
| 6,276,997 B1 | | 8/2001 | Li | 451/41 |
| 6,312,319 B1 | * | 11/2001 | Donohue et al. | 451/56 |
| 6,329,299 B1 | | 12/2001 | Wu et al. | 438/745 |
| 6,406,923 B1 | | 6/2002 | Inoue et al. | 438/4 |
| 6,451,696 B1 | | 9/2002 | Hara et al. | 438/691 |
| 6,585,562 B2 | * | 7/2003 | Gitis et al. | 451/5 |
| 6,623,341 B2 | * | 9/2003 | Tolles | 451/288 |

OTHER PUBLICATIONS

Letter dated Oct. 16, 2003, disclosing information pursuant to M.P.E.P. §§2001.04 and 2001.06.

* cited by examiner

*Primary Examiner*—John F. Niebling
*Assistant Examiner*—Andre' C. Stevenson
(74) *Attorney, Agent, or Firm*—Trop, Pruner & Hu, P.C.

(57) ABSTRACT

A method and system for reclaiming virgin test wafers by polishing a very thin layer from the wafer surface, applying a low down force between the wafer and the pad, with a dilute, low basic slurry. By polishing only a few hundred Angstroms of silicon from the wafer surface, a virgin test wafer may be repeatedly reclaimed and reused for periodic defect monitoring.

10 Claims, 1 Drawing Sheet

RECLAIMING VIRGIN TEST WAFERS

BACKGROUND

This invention relates to the field of semiconductor fabrication, and specifically to testing for surface defects and/or particles in semiconductor wafer production.

It is critically important in semiconductor manufacturing to reduce or minimize surface defects in integrated circuits formed on wafers. Surface detects, for example, may include particles that are added to the surface of a wafer. The number of particles on a wafer surface may be determined and monitored to assure that production yield is maintained at an acceptable level, and to prevent detect density from reaching an unacceptable level. For example, one source of particles is semiconductor tools or equipment. The number of particles added to a wafer per product pass through the tool may be determined or specified by running a test wafer through the tool before production semiconductor wafers are started. Thus, periodic defect monitoring may be used to test the cleanliness or condition of a tool and/or process before production semiconductor wafers are processed or handled by that tool or process.

In periodic defect monitoring, one or more test wafers may be used. A virgin test ("VT") wafer is a bare silicon slice that has not been used or exposed to the conditions or steps of process characterization. VT wafers may be suitable for monitoring particles or defects that are added by a particular tool or process. The number and type of particles added to the VT wafer may depend on the status and condition of the tool, for example.

After a VT wafer has been used for periodic defect monitoring, a grinding, lapping or polishing tool may be used to remove silicon from the wafer surface, reducing the wafer thickness by between about 10 microns and about 20 microns or more. Typically, this reduction in wafer thickness means that the virgin test wafer cannot be reused again more than once or, at most, very few times.

In some instances, such as where defect quality is measured on process films, a VT wafer may not be reused again. For example, test wafers having thin epitaxial surfaces of about 2 microns to about 4 microns cannot be reclaimed or reused because grinding, lapping or polishing processes remove a greater thickness.

Use of VT wafers to monitor defects or particles added by semiconductor processing tools or equipment is very costly. For example, several VT wafers may be used for each new production wafer start, and the number of VT wafers used may vary depending on the maturity of the tool and the process.

A system and method are needed to extend the useful life of virgin test wafers and to allow them to be reclaimed and reused repeatedly in the testing for particles and surface defects produced in various tools and processes.

DETAILED DESCRIPTION

Figure 1:
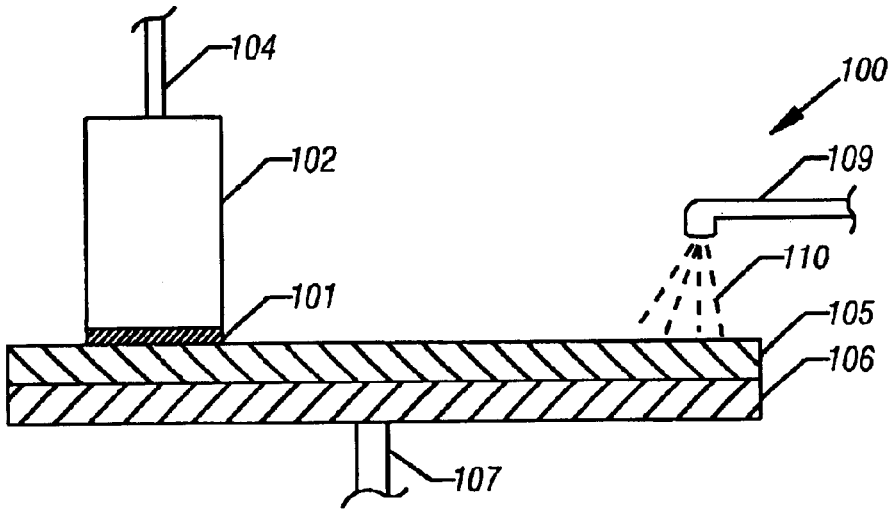
FIG. 1 is a schematic representation of a polishing system for reclaiming virgin test wafers according to one embodiment of the invention.

In FIG. 1, polishing system 100 is shown in which semiconductor wafer 101 is positioned and removably held by a polishing head 102 having a wafer carrier or wafer holder. The back side of the wafer faces the polishing head and is held thereto by conventional means such as vacuum suction. During polishing, the polishing head may be rotated about its central axis 104. In addition to rotating the wafer, the polishing head may be adapted to move the wafer laterally or vertically.

In one embodiment, the wafer may be a virgin test wafer, or a wafer that has been polished previously at least once using the method and system of the present invention. As will be described below, a virgin test wafer may be polished and re-used as many as several hundred times or more using the method and process of this invention.

The polishing system includes polishing pad 105 which is mounted and secured on the top side of polishing platen 106. The platen may be rotated about its central axis 107. The amount of silicon or other material removed from the wafer surface may be controlled by the platen rotation speed and the down force applied to the wafer on the polishing head.

In one embodiment, the platen rotation speed is between about 10 revolutions per minute and about 100 revolutions per minute. In one embodiment, the down force pressure applied to the wafer is between about 0.05 pounds per square inch and about 4.5 pounds per square inch, and most preferably less than about 1.0 pound per square inch. The down force should be controlled within plus or minus 0.03 pounds per square inch to 0.08 pounds per square inch. The low down force applied to the wafer limits the polish rate, and also helps prevent damage to the wafer surface and enhances the life of the polishing pad. In one embodiment, the platen rotation speed and down force enables the polish rate uniformity to be within about 10% to about 12%.

In one embodiment, the total amount of silicon or other material removed from the wafer surface is less than about 500 Angstroms on single silicon crystal. Preferably, the removal rate should be less than about 200 Angstroms per minute removed from the wafer surface.

The polishing process may remove particles on the surface of the wafer including particles that may be chemically bonded, adhered or attached to the wafer surface. For example, particles may adhere to silicon or silicon dioxide by static forces, other electrical charges, or bonding with oxides on the surface of a wafer. In accordance with one embodiment, the polishing method may remove particles as small as about 0.07 microns as well as much larger particles (i.e, 25 microns or larger) from the wafer surface.

Figure 2:
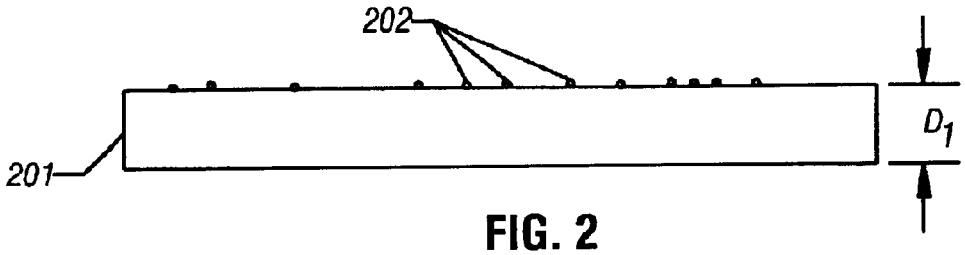
FIG. 2 is a side view representation of a virgin test wafer after addition of particles on the surface thereof.

FIG. 2 depicts a semiconductor wafer 201 after use for periodic defect monitoring, in which particles 202 are found on or adjacent the wafer surface. Before polishing, the wafer has thickness $D_1$. Polishing according to one embodiment of the present invention breaks the surface attachments or bonding between the particles and the wafer.

Figure 3:
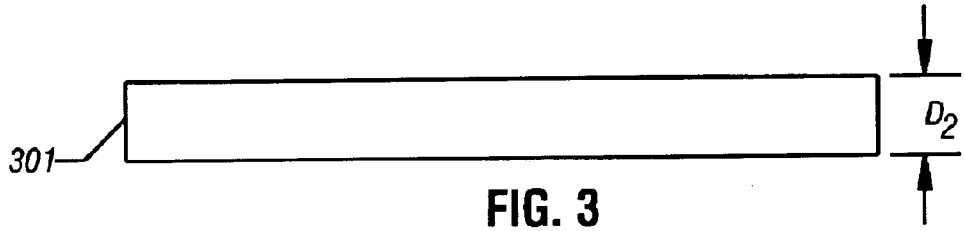
FIG. 3 is a side view representation of a virgin test wafer after polishing to remove surface particles therefrom.

As shown in FIG. 3, after polishing to remove the particles from the wafer surface, wafer 301 has a thickness $D_2$ which is not more than 500 Angstroms thinner than $D_1$. The polishing system and process are not intended to reach or remove particles that are embedded more deeply than about 500 Angstroms into the wafer. Thus, the present invention is directed to removal of surface particles and/or defects from or immediately adjacent the surface of a virgin semiconductor wafer, rather than to removal or eradication of internal defects.

Referring again to FIG. 1, in one embodiment, the polishing system may include dispenser 109 which may provide an abrasive polishing slurry 110 that is poured onto the polishing pad. In one embodiment, the slurry includes a fluid having a pH in the range between about 8.0 and about 9.5. In one embodiment, the fluid also may include an organic amino acid, an organic acid, an inorganic acid, or a combination of two or more of the above. In one embodiment, the slurry may have a specific gravity of about 1.01 to about 1.08, and average particle size may be between about 25 nanometers and about 50 nanometers, filtered through a 0.1 to 0.25 micron mesh filter. An example of a slurry that may be used is ultra pure $SiO_2$ or $Al_2O_3$ which may be diluted with de-ionized water in a ratio of one part slurry to one part de-ionized water, to one part slurry to 25 parts de-ionized water.

In one embodiment, a gentle pad conditioner may be used to treat and condition the surface of polishing pad 105 after a wafer is polished, thus removing particles and/or byproduct debris from the polishing pad. The pad conditioner is preferably bundles of different stiffness bristle brushes in the form of pellets mounted in the pad conditioner. For example, each conditioner may comprise about 400 to about 1200 mounted pellets on the conditioner head, with a bundle of bristles mounted in each pellet. In one embodiment, the bristle height should be between about 4 mm and 8 mm, with soft to medium-hard stiffness. The pad conditioner may be held on a vertical cylinder, and rotated at between about 10 revolutions per minute and about 150 revolutions per minute to condition the polishing pad between wafers. The use of a pad conditioner is optional, for example to extend the life of the pad.

After polishing to remove a very thin layer of silicon from the wafer surface, the wafer surface may be cleaned, rinsed and/or scrubbed with a chemical liquid and the wafer may be re-used again as a VT wafer for detection of particle contamination. Thus, the silicon polish process may be used to generate a new VT wafer from a used VT wafer. Only a few hundred Angstroms of silicon are removed, so a VT wafer may be reused many times. Because only a few hundred Angstroms of silicon are removed from the wafer surface, this method also may be used for epi test wafers as well as VT wafers.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

positioning a semiconductor test wafer on a rotatable head;

applying the semiconductor test wafer to a rotatable polishing pad; and polishing the surface of the semiconductor test wafer to remove less than about 500 Angstroms therefrom.

2. The method of claim 1 further comprising applying an abrasive slurry to the rotatable polishing pad.

3. The method of claim 1 further comprising applying a pressure to the semiconductor test wafer against the polishing pad of less than about 1.0 pound per square inch.

4. The method of claim 1 further comprising removing less than about 200 Angstroms per minute from the semiconductor test wafer.

5. The method of claim 1 further comprising conditioning the rotatable polishing pad with a bristled brush after polishing the semiconductor test wafer.

6. A method comprising:

detecting particle defects added to the surface of a virgin test wafer by a semiconductor manufacturing tool;

polishing the virgin test wafer with a polishing pad to remove less than about 500 Angstroms from the surface thereof; and re-using the virgin test wafer to detect particle defects in a semiconductor manufacturing tool.

7. The method of claim 6 further comprising conditioning the polishing pad with a plastic bristled brush after polishing the virgin test wafer.

8. The method of claim 6 further comprising rotating the polishing pad at a speed between about 10 revolutions per minute and about 100 revolutions per minute.

9. The method of claim 6 further comprising applying a down force pressure to the virgin test wafer of between about 0.05 pounds per square inch and about 4.5 pounds per square inch.

10. The method of claim 6 further comprising applying an abrasive slurry to the polishing pad, the abrasive slurry having an average particle size between about 25 nanometers and about 50 nanometers.

* * * * *